US011572734B1

(12) United States Patent
Kendall

(10) Patent No.: US 11,572,734 B1
(45) Date of Patent: Feb. 7, 2023

(54) CONNECTOR SYSTEM, APPARATUS AND METHODS FOR A DOOR FRAME ASSEMBLY

(71) Applicant: Endura Products, LLC, Colfax, NC (US)

(72) Inventor: Adam Kendall, Burlington, NC (US)

(73) Assignee: Endura Products, LLC, Colfax, NC (US)

( * ) Notice: Subject to any disclaimer, the term of this patent is extended or adjusted under 35 U.S.C. 154(b) by 0 days.

(21) Appl. No.: 17/195,135

(22) Filed: Mar. 8, 2021

Related U.S. Application Data

(63) Continuation of application No. 16/561,116, filed on Sep. 5, 2019, now Pat. No. 10,941,606.

(60) Provisional application No. 62/727,790, filed on Sep. 6, 2018.

(51) Int. Cl.
*E06B 1/52* (2006.01)

(52) U.S. Cl.
CPC ..... *E06B 1/524* (2013.01)

(58) Field of Classification Search
CPC ..... E06B 1/524; E06B 1/526
See application file for complete search history.

(56) References Cited

U.S. PATENT DOCUMENTS 1,950,519 A ‡ 5/1932 Ripley ..... E06B 1/62 52/97
2,317,231 A ‡ 4/1943 Swedman ..... F16B 15/02 411/481
2,616,531 A ‡ 11/1952 Young ..... E06B 3/4654 52/211
2,863,534 A ‡ 12/1958 Gillespie ..... E06B 1/18 52/204.54
3,371,702 A ‡ 3/1968 Keegan ..... E06B 3/285 160/392
3,609,928 A ‡ 10/1971 Mock ..... E06B 1/30 52/210
3,774,344 A ‡ 11/1973 Symons ..... F16B 12/02 49/504
3,991,806 A ‡ 11/1976 Abell ..... E06B 3/285 160/90
4,086,739 A ‡ 5/1978 Hall ..... E04B 2/60 52/281
4,184,297 A ‡ 1/1980 Casamayor ..... E06B 3/28 52/202
4,258,520 A ‡ 3/1981 Rehbein ..... E04B 7/22 52/309.16
4,330,972 A ‡ 5/1982 Sailor ..... E06B 1/32 49/504
4,361,979 A ‡ 12/1982 Petersson ..... A63H 33/108 403/292
4,407,100 A ‡ 10/1983 Huelsekopf ..... E06B 1/30 49/504

(Continued)

FOREIGN PATENT DOCUMENTS

JP 11193625 A * 7/1999

*Primary Examiner* — Patrick J Maestri
(74) *Attorney, Agent, or Firm* — MacCord Mason PLLC

(57) ABSTRACT

A system, device, assembly and methods for a frame assembly, including a connector as shown and described. The assembly may be a door frame assembly and may, by way of example, be a door jamb and/or a door mullion including a connector. A connector may provide stability to the assembly.

11 Claims, 5 Drawing Sheets

(56) References Cited

U.S. PATENT DOCUMENTS 4,452,029 A ‡ 6/1984 Sukolics ..... E04B 1/617 52/385
4,454,699 A ‡ 6/1984 Strobl ..... F16B 21/082 403/298
4,608,796 A ‡ 9/1986 Shea, Jr. ..... E06B 1/36 52/204.595
4,665,666 A ‡ 5/1987 Hampton ..... E06B 1/006 52/211
4,947,597 A ‡ 8/1990 Simpson ..... E06B 3/5892 52/204.591
5,003,743 A ‡ 4/1991 Bifano ..... E04F 13/06 52/288.1
5,027,572 A ‡ 7/1991 Purcell ..... E04B 1/66 52/309.9
5,062,250 A ‡ 11/1991 Buzzella ..... E04D 3/352 52/586.2
5,182,880 A ‡ 2/1993 Berge, Jr. ..... E06B 1/34 49/460
5,261,756 A ‡ 11/1993 Kohn ..... F16B 7/0413 403/292
5,313,755 A ‡ 5/1994 Koenig, Jr. ..... E04F 13/06 52/255
5,377,464 A ‡ 1/1995 Mott ..... E06B 1/62 52/213
5,378,007 A ‡ 1/1995 Joyce ..... B62D 53/08 280/407
5,398,468 A ‡ 3/1995 Erickson ..... A47F 5/0846 211/94.01
5,448,864 A ‡ 9/1995 Rosamond ..... E04C 2/546 52/307
5,491,940 A ‡ 2/1996 Bruchu ..... B29C 65/20 49/504
5,528,869 A ‡ 6/1996 Boomer ..... E06B 1/30 49/505
5,540,019 A ‡ 7/1996 Beske ..... E06B 3/44 52/204.5
5,555,684 A ‡ 9/1996 Galowitz ..... E06B 1/342 52/204.5
5,590,496 A * 1/1997 Martin ..... E06B 1/62 206/321
5,622,017 A ‡ 4/1997 Lynn ..... B29C 66/72523 52/209
5,669,192 A ‡ 9/1997 Opdyke ..... E06B 1/34 52/211
5,791,113 A * 8/1998 Glowa ..... E06B 1/32 52/211
5,836,118 A ‡ 11/1998 Thornton ..... E06B 1/045 52/204.1
6,098,365 A ‡ 8/2000 Martin ..... E04B 1/6125 52/592.1
6,125,605 A ‡ 10/2000 Young ..... E06B 1/34 52/211
6,141,874 A ‡ 11/2000 Olsen ..... B29C 65/08 29/527.3
6,148,584 A ‡ 11/2000 Wilson ..... E04F 19/0463 52/211
6,293,060 B1 ‡ 9/2001 McKann ..... E06B 1/12 49/504
6,314,701 B1 ‡ 11/2001 Meyerson ..... E04C 2/292 52/309.9
6,360,508 B1 ‡ 3/2002 Pelfrey ..... E04F 13/0864 52/198
6,393,779 B1 ‡ 5/2002 Boldt ..... E06B 1/10 52/204.1
6,491,468 B1 ‡ 12/2002 Hagen ..... E04B 1/6803 277/316
6,568,137 B2 ‡ 5/2003 Ballantyne ..... E06B 1/32 52/204.1
6,578,332 B2 ‡ 6/2003 Bushberger ..... E04B 1/644 52/274
6,588,159 B1 ‡ 7/2003 Cotton, Jr. ..... E06B 1/08 49/504
6,604,334 B2 ‡ 8/2003 Rochman ..... E06B 1/34 52/211
6,675,545 B2 ‡ 1/2004 Chen ..... B29C 65/564 52/586.1
6,761,008 B2 ‡ 7/2004 Chen ..... E04F 15/02033 52/586.1
6,904,726 B2 ‡ 6/2005 Heard ..... E06B 1/6015 49/504
7,165,690 B2 ‡ 1/2007 Wu ..... A47B 96/145 211/187
8,276,320 B2 ‡ 10/2012 Erbrect ..... E06B 7/2305 49/471
9,010,066 B1 ‡ 4/2015 Sand ..... E04F 21/0015 52/745.21
9,187,945 B2 * 11/2015 Back ..... E06B 1/045
9,222,267 B2 ‡ 12/2015 Bergelin ..... E04F 15/02033
9,249,581 B2 ‡ 2/2016 Nilsson ..... E04F 15/02038
9,260,871 B2 ‡ 2/2016 Shaw ..... E04F 13/26
9,387,544 B2 ‡ 7/2016 Phebus ..... B23F 1/04
9,534,402 B2 ‡ 1/2017 Shaw ..... E04F 19/02
9,714,673 B2 ‡ 7/2017 Phillips ..... F16B 12/24
2002/0108326 A1 ‡ 8/2002 Ackerman, Jr. ..... E06B 1/62 52/204.5
2003/0177725 A1 ‡ 8/2003 Gatherum ..... E06B 1/62 52/302.1
2005/0257455 A1 ‡ 11/2005 Fagan ..... B29C 48/304 52/210
2006/0174577 A1 * 8/2006 O'Neil ..... E04B 1/6145 52/586.1
2007/0094985 A1 ‡ 5/2007 Grafenauer ..... E04F 15/02 52/582.1
2009/0013636 A1 ‡ 1/2009 Wilson ..... E06B 1/10 52/718.01
2010/0107524 A1 * 5/2010 Moss ..... E06B 1/34 52/745.15

* cited by examiner
‡ imported from a related application

CONNECTOR SYSTEM, APPARATUS AND METHODS FOR A DOOR FRAME ASSEMBLY

This application is a continuation of U.S. application Ser. No. 16/561,116, filed Sep. 5, 2019, which claims the benefit of U.S. provisional application No. 62/727,790, filed Sep. 6, 2018, which is herein incorporated by reference.

FIELD OF TECHNOLOGY

The present disclosure relates generally to doors and door assemblies for entranceways for example, for a building and, more particularly, to a door frame and connector system, device, apparatus, and/or methods for a door assembly for a residence/facility.

BACKGROUND

Joining of frame members for a door assembly is traditionally accomplished with fasteners such as staples, nails or screws. When these fastener types are used, a secondary operation is needed to hide the fastener in situations where improved aesthetics are desired. There can be opposing variables between securing a door frame and maintaining an aesthetically desirable appearance to the door assembly.

Thus, the Applicant recognized there remains a need for a new and improved connector for joining door frame members for door assemblies, and it is to these and other challenges that the inventions of the present disclosure are directed.

SUMMARY

The present disclosure is directed in one embodiment to a system, device, method and/or kit for joining of framing members for a door assembly by way of alternate fastening methods, by way of example, through a connector and an internal groove or set of grooves on adjoining frame members. In one example, the connector may mate with and be inserted into a groove of one or more frame members, when the frame members are abutted. As a connector and groove system joins the connector and groove and the connector and groove are assembled through abutment of the framing members, the connector may be hidden on an inside surface of the frame members.

In another embodiment, a frame assembly for a doorway may include a first frame member, a first set of grooves, a second frame member, a second set of grooves and a connector. The first frame member may include an outside exposed surface, and an inside surface. The first set of grooves may be recessed into the first frame member along the inside surface. The second frame member may include an outside exposed surface and an inside surface. The second groove may recess into the second frame member along the inside surface. The connector may join the first frame member and the second frame member with each other. The connector may include a first wall and a second wall. The first wall may be substantially perpendicular to the second wall.

Some embodiments may include a set of first projections extending from the first wall. The set of first projections may be spaced apart from one another and configured to align with the first set of grooves. An at least one second projection may extend from the second wall. The projection may be configured to align with the second groove.

A connector may be a hidden connector. The connector may span the inside surfaces of the first frame member and the second frame member and not be fully or partially visible from the outside surface of the frame assembly. The connector may secure the first frame member to said second frame member in an abutting position.

In other embodiments, the connector may span the inside walls of the first frame member and the second frame member but not protrude between a meeting face of the first frame member and the second frame member. The connector may extend at least halfway along the length of the first frame member and the connector may extend less than halfway along the length of the second frame member.

Some examples of a frame assembly for a doorway may include a first frame member having an outside exposed surface, an end surface, and an inside surface, and a second frame member having an outside exposed surface, an end surface, and an inside surface. A bridge member may have an outside surface, an end surface and an inside surface. A first connector may join the first frame member and the bridge with each other. A second connector may join the second frame member and the bridge with each other. The first connector, second connector and the bridge member may form a collective end wall. The first frame member and the second frame member may be spaced apart from one another by the end wall. The first connector and the second connector may be configured to include an opposed position to one another.

The first connector and the second connector may include a side cap, an end cover, an end extension piece for accepting the bridge, and an inside securing projection extending at an angle to the frame member. The inside securing projection may attach the respective connector to the respective inside surface of each respective frame member.

In some instances, the end cover of the first connector and the end cover of the second connector extend in a first plane with the securing projection for each frame member extending non-perpendicularly to the first plane. The securing projection of each first connector and second connector may extend from the first plane from at a range of an angle alpha. The angle alpha may be a 90 degree angle. The angle alpha may be in a range of between 70 and 100 degrees. The angle alpha, in other examples, may extend between a range of between 80 and 90 degrees. The listed ranges are exemplary and the angle alpha could include other dimensions, ranges and/or any of the ranges within or outside of those listed as examples.

The first connector and the second connector may be separated from one another by said bridge member. The first connector and the second connector may extend from one another. The first connector and second connector may form one piece.

In some examples, a frame member may be a jamb, a mullion, a bridge, a trim piece, and/or a combination of any of these listed.

The inventions of the present disclosure include forming a mullion by way of a set of opposing jambs, a set of opposing extenders and a bridge.

Other examples include a frame assembly including an end wall forming a complete end cap covering the first and second frame members. There may be a space formed in-between, and the projection for the first connector and the second connector may be encased inside an interior space between the first frame member inside surface and the second frame member inside surface.

The inventions of the present disclosure may be considered a method for securing a doorway frame joint by way of any of the embodiments disclosed herein.

The inventions of the present disclosure may be considered a connector for a door frame according to any of the embodiments disclosed herein.

These and other aspects of the inventions of the present disclosure will become apparent to those skilled in the art after a reading of the following description of embodiments when considered with the drawings.

DESCRIPTION OF EMBODIMENTS

Figure 1A:
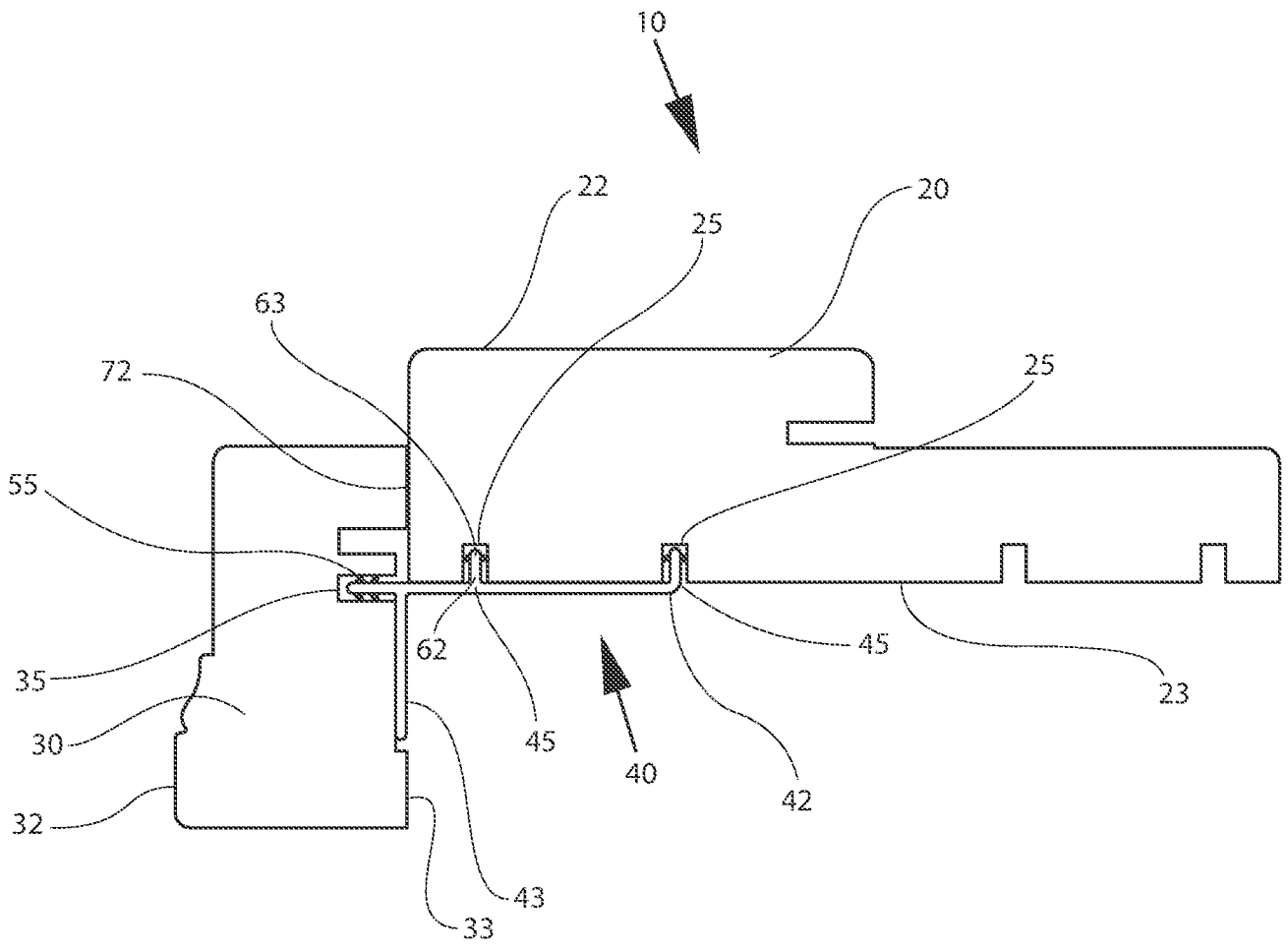
FIG. 1A is a cross-sectional view of one embodiment of a frame assembly for a door constructed according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general, it will be understood that the illustrations are for the purpose of describing a preferred embodiment of the inventions and are not intended to limit the inventions thereto. A door frame often includes one or more frame members. A plurality of frame members may include any combination of a header, a sill, mullion components, jamb components, and/or a trim component. A header may be generally placed toward the top of a door assembly. Mullions and jambs components may be generally placed at opposing sides of a door panel. Frame assemblies may also include hinges for connecting door panels to at least one of the frame members. The frame assembly may also include locking hardware that enables the door to be secured to as least one of the frame members and/or to another frame member. Locking hardware, by way of example, may include latch and deadbolt plates.

Figure 1B:
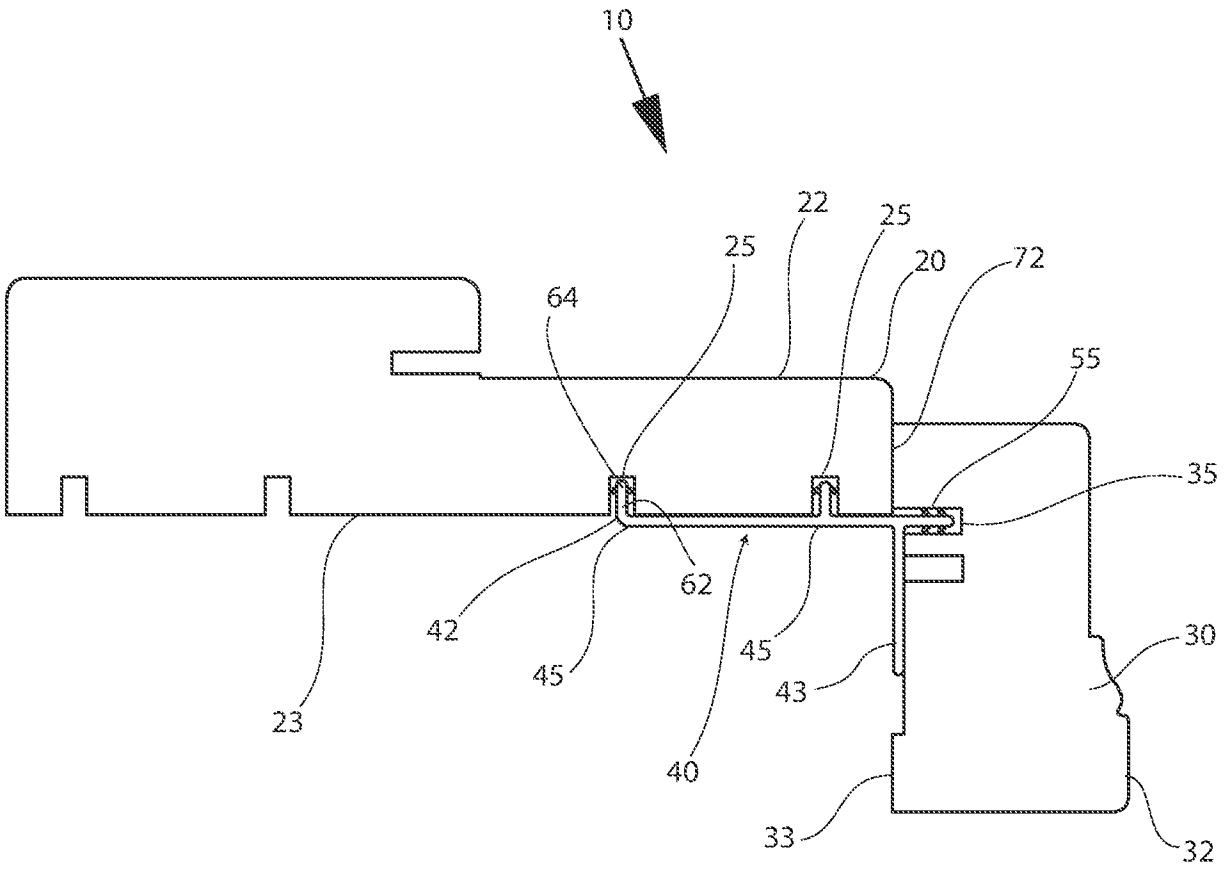
FIG. 1B is a cross-sectional view of another embodiment of a frame assembly for a door frame constructed according to the present disclosure.
Figure 2:
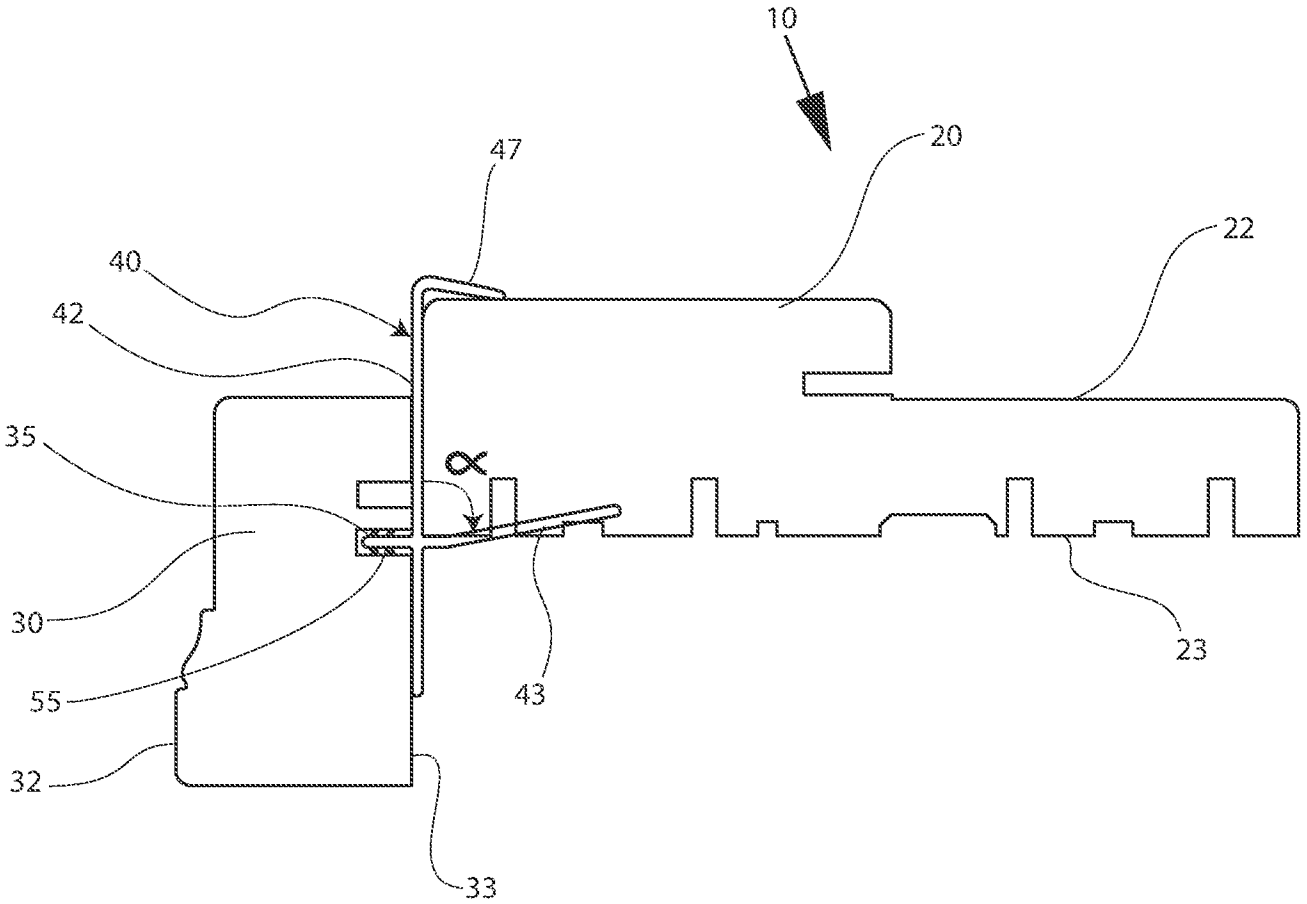
FIG. 2 is a side view of another embodiment of a frame assembly for a door frame constructed according to the present disclosure.

FIGS. 1A, 1, and 2 show, in one embodiment, a door frame assembly 10 for a door frame. A frame assembly 10 for a doorway may include a first frame member 20 having a first set of grooves 25, a second frame member 30 having a second set of grooves 35, and a connector 40. The first frame member 20 may include an outside exposed surface 22, and an inside surface 23. The first set of grooves 25 may be recessed into the first frame member 20 along the inside surface 23. The second frame member 30 may include an outside exposed surface 32 and an inside surface 33. The second groove 35 may recess into the second frame member 30 along the inside surface 33.

The connector 40 may assist in joining the first frame member and the second frame member with each other. The connector 40 may include a first wall 42 and a second wall 43. The first wall may be substantially perpendicular to the second wall.

A connector 40 may be a hidden connector. The connector 40 may span the inside surfaces 23, 33, of the first frame member 20 and the second frame member 30 and not be fully or partially visible from the outside surfaces of the frame assembly 22, 32. The connector 40 may secure the first frame member 20 to the said second frame member 30 in an abutting position. In other embodiments, the connector 40 may span the inside walls 23, 33 of the first frame member 20 and the second frame member 30 but not protrude between a meeting face 72 of the first frame member 20 and the second frame member 30. The connector 40, in some embodiments, may extend at least halfway along the length of the first frame member 20, and may extend less than halfway along the length of the second frame member 30. The first wall 42 may be longer than the second wall 43. The second wall may or may not include second projections 55. The second projection 55 may be an extension of the first wall 42 that extends past an intersection with the second wall 43.

Some embodiments may include a set of first projections 45 extending from the first wall 42. The set of first projections 45 may be spaced apart from one another and configured to align with the first set of grooves 25. An at least one second projection 55 may extend from the second wall 43. The projection 55 may be configured to align with the second groove 35. Projections 45, 55 may be linear projections. Projections 45, 55 may include an attachment end 62 and a terminating end 63. Projections 45, 55 may include one or a set of barbs 64. The barbs 64 may be positioned between the attachment end 62 and the terminating end 63. The barbs may be made of coextruded flexible material to help maintain engagement of the projections 45, 55 within the grooves.

Projections 45, 55, in some examples, may include a first set of projections 45 oriented and/or pointing in one direction and a second projection 55 oriented and/or pointing in a different, second direction.

In some examples, a second projection 55 may extend linearly along a same plane as a first wall 42. The second projection 55 may project beyond a plane formed by the second wall 43.

The frame assembly may, by way of example, be configured to form a trisecting jointed wall between the first frame member 20, second frame member 30 and connector 40, one example as shown in FIG. 2.

Figure 3:
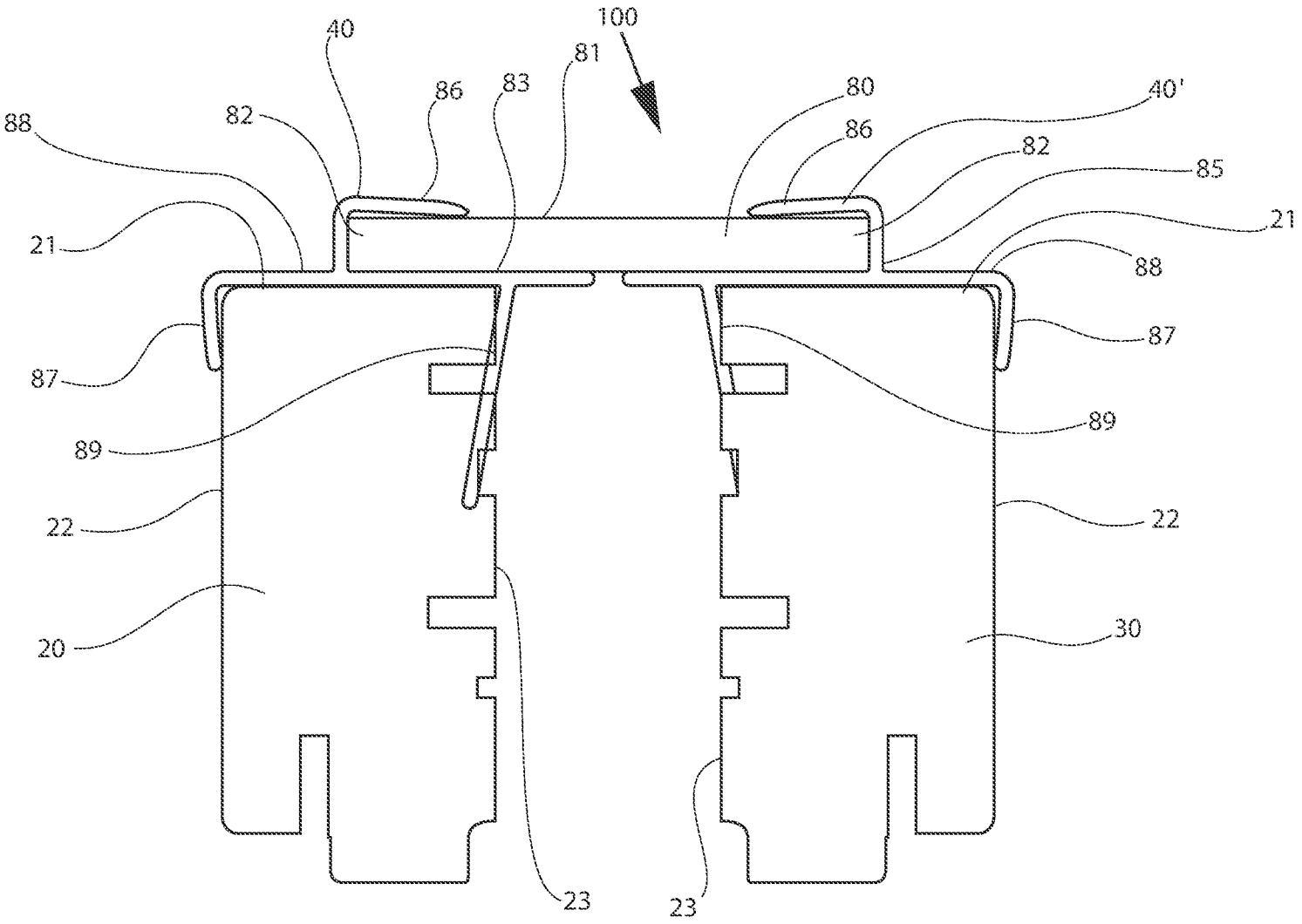
FIG. 3 is a side view of another embodiment of frame assembly for a mullion door frame constructed according to the present disclosure.

Some examples of a frame assembly 100 for a doorway, one example of which is seen in FIG. 3, may include a first frame member 20 having an outside exposed surface 22, an end surface 21, and an inside surface 23, and a second frame member 30 having an outside exposed surface 22, an end surface 21, and an inside surface 23. A bridge member 80 may have an outside surface 81, an end surface 82, and an inside surface 83. A first connector 40 may join the first frame member 20 and the bridge member 80 with each other. A second connector 40' may join the second frame member 30 and the bridge member 80 with each other. The first connector 40, second connector 40' and the bridge member 80 may form a collective end wall 85. The first frame member 20 and the second frame member 30 may be spaced apart from one another by at least a portion of the end wall 85. The first connector 40 and the second connector 40' may be configured to take on an opposed position configuration to one another.

The first connector 40 and/or the second connector 40' may include a side cap 87, an end cover 88, and an end extension piece 86 for accepting the bridge member 80, and an inside securing projection 89 extending at an angle to the frame member 20, 30. The inside securing projection 89 may attach the respective connector 40, 40' to the respective inside surface 23 of each respective frame member. The projection 89 may be secured to the frame member by a fastener, such as, by way of example, a staple, adhesive, or a nail.

In some instances, the end cover 88 of the first connector 40 and the end cover 88 of the second connector 40' extend in a first plane with the securing projection 89 for each frame member extending non-perpendicularly to the first plane. The securing projection 89 of each first connector 40 and second connector 40' may extend from the first plane from at a range of an angle alpha. The angle alpha may be a 90 degrees angle. The angle alpha may be in a range of between 70 and 100 degrees. The angle alpha, in other examples, may extend between a range of between 80 and 90 degrees. The listed ranges are exemplary and the angle alpha could include other dimensions, ranges and/or any of the ranges within or outside of those listed as examples.

The first connector 40 and the second connector 40' may be separated from one another by a length of the bridge member 80. The first connector 40 and the second connector 40' may extend from one another. The first connector and second connector may form one piece.

In some examples, a frame member assembly may be a jamb, a mullion, a bridge, a trim piece, and/or a combination of any of these listed.

The inventions of the present disclosure include forming a mullion by way of a set of opposing jambs, a set of opposing extenders and a bridge.

In some examples, an extension piece for accepting the bridge member 80 forms a U-shaped acceptor.

Figure 4:
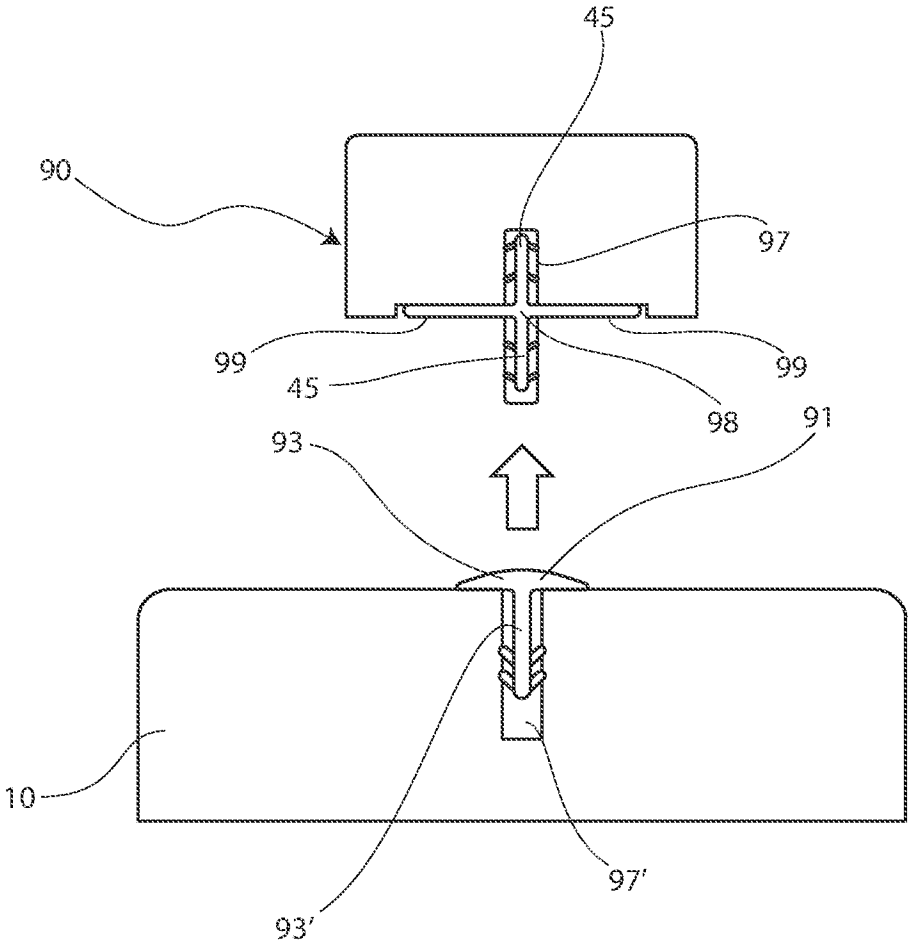
FIG. 4 is a side view of one example of a groove cover and extension for a frame member according to the present disclosure.

In examples of a frame assembly 10, for example, a jamb or a mullion, an extension member 90 may be included and may attach to a frame assembly 10, an example of an extension being partially shown in FIG. 4. The extension member 90 may include a groove 97. The frame member 10 may include a groove 97'. When a groove is not in use in the frame member 10, a groove cover 91 may be utilized and fitted into the groove. The groove cover may have a top 93 that covers a groove opening and a groove cover projection 93'. The groove cover may take on a configuration similar to the projections as disclosed herein. A joint extension 98 may alternatively project into groove 97 and on one side and groove 97' on an opposite side. The joint extension 98 may include projections 45, and may have arms 99 that extend, in some examples, perpendicularly to projections 45. The joint extension 98 may serve to secure the frame member 10 to the extension member 90.

Other examples of the enclosed embodiments include a frame assembly 100 including an end wall forming a complete end cap covering the first 20 and second frame members 30. There may be a space formed in-between the frame members 20, 30, and the projection 89 for the first connector 40 and the second connector 40' may be encased inside an interior space between the first frame member inside surface 23 and the second frame member inside surface 23. The projection 89 may an interior space and also extend into the inside surface 23 respectively of first frame member 20 and second frame member 30.

The inventions of the present disclosure may be considered a method for securing a doorway panel joint by way of any of the embodiments disclosed herein.

The inventions of the present disclosure may be considered a connector for a door panel according to any of the embodiments disclosed herein.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A door frame assembly comprising:

a cross shaped connector for a frame member, a door frame member, an extension member, a set of arms projection that extends linearly along a same plane as the surface of the extension member, wherein the set of arms are recessed into the surface of the extension member, and wherein said cross shaped connector is removable and forms a joint extension and extends into a groove on an exterior surface of the door frame member and also into a groove on the surface of the extension member, said connector being enclosed within a joint formed between the door frame member and the extension member, said connector providing a support for the over all door frame and extension member assembly.

2. The door frame assembly of claim 1 including projections extending into the groove of the door frame and the groove of extension member.

3. The frame assembly of claim 2, said projections including an attachment end and terminating end.

4. The frame assembly of claim 3, the projections including a set of barbs positioned between the attachment end and the terminating end.

5. The frame assembly of claim 1 wherein a first projection points in a first direction and a second projection points in a second direction.

6. The frame assembly of claim 1 wherein said connector is interchangeable with a groove cover.

7. The frame assembly of claim 1 wherein said frame member is a jamb.

8. The frame assembly of claim 1 wherein said frame member is a mullion.

9. The frame assembly of claim 8, wherein said extension extends the frame assembly.

10. The frame assembly of claim 6, wherein said groove cover includes a projection that secures the groove cover inside the frame member groove.

11. The frame assembly of claim 1 wherein said exterior surface of the door frame member and said surface of the extension member mate to form a space in-between, and said connector is encased inside said space.

* * * * *